US009909763B2

(12) United States Patent
Rickert et al.

(10) Patent No.: US 9,909,763 B2
(45) Date of Patent: Mar. 6, 2018

(54) METHOD OF POT DETECTION AND GAS HOB

(71) Applicant: E.G.O. Elektro-Geraetebau GmbH, Oberderdingen (DE)

(72) Inventors: Jochen Rickert, Angelbachtal (DE); Daniel Parker, Pfinztal (DE); Elmar Herweg, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 272 days.

(21) Appl. No.: 14/842,371

(22) Filed: Sep. 1, 2015

(65) Prior Publication Data

US 2016/0084506 A1 Mar. 24, 2016

(30) Foreign Application Priority Data

Sep. 18, 2014 (DE) ..... 10 2014 218 741

(51) Int. Cl.
*F24C 3/12* (2006.01)

(52) U.S. Cl.
CPC ..... *F24C 3/126* (2013.01)

(58) Field of Classification Search
USPC ..... 126/42, 39 E, 52
See application file for complete search history.

(56) References Cited

U.S. PATENT DOCUMENTS 4,499,368 A 2/1985 Payne
4,681,084 A * 7/1987 Grech ..... F24C 3/126 126/39 E
5,648,008 A * 7/1997 Barritt ..... H05B 6/062 219/626
6,462,316 B1 10/2002 Berkcan et al.
6,619,613 B1 9/2003 Akamatsu et al.
2008/0276923 A1 11/2008 Clauss et al.
(Continued)

FOREIGN PATENT DOCUMENTS

DE 4218278 A1 12/1993
DE 102013218339 A1 3/2015
(Continued)

OTHER PUBLICATIONS

European Patent Office, Extended European Search Reort for Application No. 15183732.5, dated Jan. 14, 2016, 9 pages, Germany.

*Primary Examiner* — Avinash Savani
(74) *Attorney, Agent, or Firm* — Alston & Bird LLP

(57) ABSTRACT

In the case of a method of pot detection at a gas cooking point with a gas burner, a thermocouple is fitted at the gas cooking point for flame sensing, to be precise in such a way that with every output of the gas burner possible for a sustained period it is impinged by the flame. In order to detect whether a pot has been placed onto the gas cooking point while the gas burner is in operation or whether the pot has been taken away, the thermoelectric voltage is tapped at the sensing means and evaluated by a comparison of the signal at the time with the signal in the case where a pot has been placed on. A different flame prevails at the thermocouple when a pot has been placed on than when the pot has been taken away, and the temperature is different. The output at the gas cooking point is reduced as a reaction to detection of the taking away of the pot.

16 Claims, 1 Drawing Sheet

(56) References Cited

U.S. PATENT DOCUMENTS

| | | | |
|---|---|---|---|
| 2010/0239987 | A1 | 9/2010 | Baier |
| 2011/0083663 | A1 | 4/2011 | Baier et al. |
| 2012/0097148 | A1 | 4/2012 | Schönemann et al. |
| 2014/0295357 | A1 | 10/2014 | McAfee et al. |

FOREIGN PATENT DOCUMENTS

| | | | |
|---|---|---|---|
| EP | 1152190 | A1 | 11/2001 |
| EP | 2230462 | A2 | 9/2010 |
| EP | 2444726 | A2 | 4/2012 |
| EP | 2863128 | A1 | 4/2015 |
| WO | WO 2014/160570 | A1 | 10/2014 |

* cited by examiner

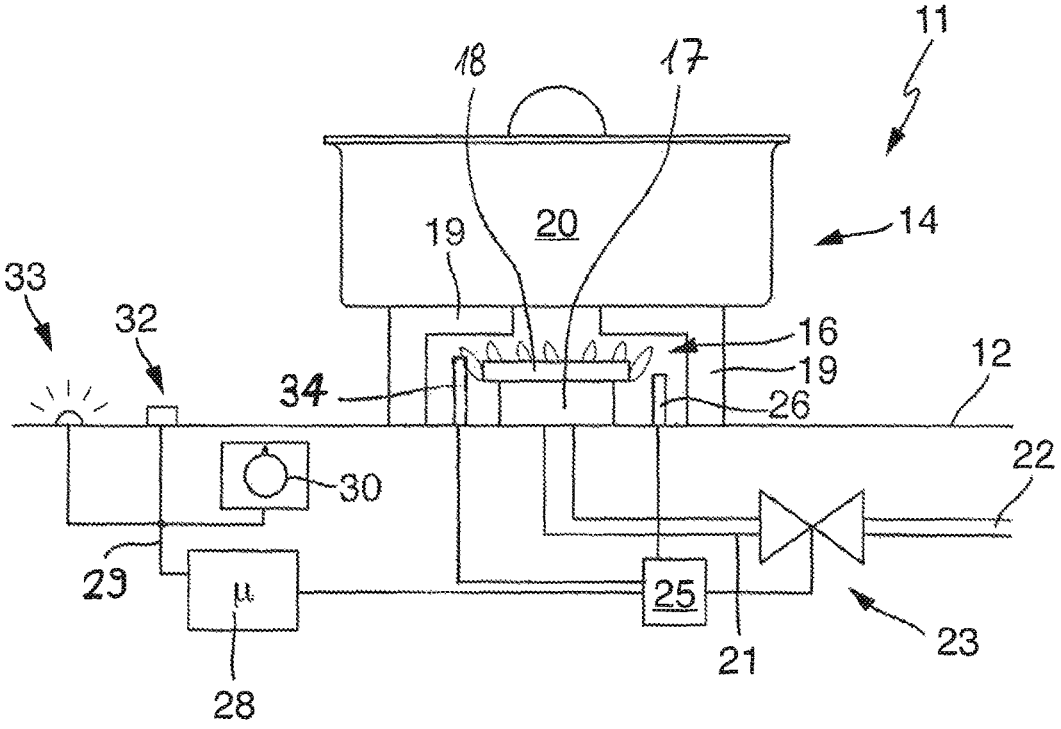
11
18
17
14
19
20
33
32
16
19
12
34
26
22
30
29
μ
25
23
21
28

METHOD OF POT DETECTION AND GAS HOB

CROSS-REFERENCE TO RELATED APPLICATIONS

This application claims priority to German Application No. 10 2014 218 741.9, filed Sep. 18, 2014, the contents of which are hereby incorporated herein in its entirety by reference.

TECHNOLOGICAL FIELD

The invention relates to a method of pot detection at a gas cooking point with a gas burner, the gas cooking point being arranged on a gas hob. The gas hob advantageously has a number of such gas cooking points. The invention also relates to a gas hob designed for carrying out this method.

BACKGROUND

It is known from DE 4218278 A1 to provide a sensing means in the form of a monitoring electrode at a gas cooking point with a gas burner. This electrode is at such a distance from the burner that the flame pattern of the gas burner only heats the monitoring electrode, or the flames only impinge on it more or less directly, when a pot has been placed onto the cooking pot of the gas burner. If the pot is taken away, the flames of the gas burner pass by the monitoring electrode at such a distance that the ionization current via the monitoring electrode is interrupted, which usually leads to automatic switching off of the gas supply, which is controlled by an automatic firing system connected to the monitoring electrode.

BRIEF SUMMARY

The invention addresses the problem of providing a method mentioned at the beginning and a gas hob designed for carrying it out with which problems of the prior art can be avoided and it is possible in particular to detect reliably when a pot is taken away from the gas cooking point and also to provide functions or convenience functions associated with this or based on this.

This problem is solved by a method and a gas hob of the invention. Advantageous and preferred configurations of the invention are the subject of the further claims and are explained in more detail below. In this case, some of the features are described only for the method or only for the gas hob. However, irrespective of this, they are intended to be able to apply independently both to the method and to the gas hob. The wording of the claims is made the content of the description by express reference.

It is provided that a sensing means, which has a function for flame or temperature sensing and is designed as an ionization electrode or as a thermocouple, is provided or fitted at the gas cooking point. In this case, is not actually an absolute temperature that is measured at the thermocouple but only a temperature difference between a base point and a measuring point. Either the respective temperature is then determined on this basis, from a room temperature as a comparison, and a temperature difference is determined from that, or only temperature differences are considered in any case. Advantageously, only temperature differences between a pot being placed on and a pot being taken away are evaluated. This is the case even when the pot is taken away again directly after the cooking point is put into operation, since here the base point would still be close to room temperature. Preferably, only a single such sensing means is provided at this gas cooking point, which keeps down the structural complexity and also the effort involved in activation and evaluation. The sensing means is fitted at the gas cooking point in such a way that, during the operation of the gas burner, with every output of the gas burner possible for a sustained period it is impinged directly by its flames or else is at least always impinged by the hot gas stream of the flames. This therefore applies both to operation at the maximum output of the gas burner and also at its minimum output. In particular, the ionization electrode or the thermocouple experiences the change in the flame, that is to say that the sensing means does not always have to be completely in the flame, but is always at least exposed to the hot gas stream. This could be for example when it is between two flame cones of the gas flame.

In order to detect whether a pot has been placed onto the gas cooking point while the gas burner is in operation, or is still in place, or whether it has been taken away, an electrical signal is tapped at the sensing means and evaluated, in particular in terms of the variation over time. Depending on the configuration of the sensing means as an ionization electrode or a thermocouple, this may be an ionization current or a thermoelectric voltage, which flow through the sensing means or are present at it. This tapped electrical signal is evaluated by a comparison of the signal at the time with the signal in the case where a pot has been placed on. This corresponds to the signal that was present shortly before the pot was taken away. This is so because a different temperature prevails at the sensing means, or the flame has a different form, and possibly a higher temperature prevails or a flame burns in a different form, when a pot has been placed on than when the pot has been taken away, when another or possibly a lower temperature prevails. For this reason, it may indeed also be advantageous to rely on the aforementioned temperature differences. Whether a higher or lower temperature prevails at the thermocouple or the ionization electrode when the pot has been taken away depends largely on its positioning. The flame itself has a consistent burner output, only its form changes as a result of the taking away or placing on of the pot. Unlike in the case of the aforementioned DE 4218278 A1, however, even with the pot taken away, the sensing means is still impinged directly by the flames or is at least impinged by their hot gas stream. Consequently, with the pot taken away, the signal of the sensing means does not simply stop completely, but is still present, though only as a smaller signal or a signal of a different specific type, which makes more reliable evaluation possible. It is thus clearly smaller than with a pot placed on, which makes good differentiation possible.

In one configuration of the invention it is possible that, after the detection of the taking away of the pot, the output at the gas cooking point is reduced, to be precise to the minimum output of this cooking point or to the minimum output of this gas burner. The minimum output here is that output with which the gas burner can still just about be operated for a sustained period and in a reliable way. This means that, with this configuration, the gas burner is not completely switched off straightaway. In this case, it may advantageously be provided that the reduction in the output to the minimum output takes place immediately when the taking away of the pot has been detected. It is therefore not left for a certain time, which could lead an operator to the wrong conclusion that the gas burner would simply continue to burn with the previous output for a very long time. One advantage of the gas burner continuing to burn with the minimum output is that then the gas consumption is not particularly great. At the same time, however, as still to be explained below, it is possible under some circumstances to put the gas burner back into operation with an output above the minimum output when the pot is placed on again without renewed ignition of the flame having to take place. This is advantageous because this ignition of the gas flame would then generally require manual intervention by an operator again, since no means that could sense the placing of the pot onto the gas cooking point are otherwise provided. With the gas burner switched off, there is also no possibility of using or evaluating a different behavior of the gas flame dependent on the placing on of the pot.

In the case of an advantageous embodiment of the invention, in the case where the gas burner is a two-ring gas burner, a second ring or an outer ring may be switched off entirely. A first ring or an inner ring may be operated with reduced output, advantageously in a way similar to that previously described with a minimum output applying to this first ring or inner ring. Consequently, under some circumstances manual intervention by an operator to re-ignite the gas burner after renewed placing of the pot onto the gas cooking point is once again not absolutely necessary. At the same time, the gas consumption is minimized as much as possible by the switching off of the second ring or outer ring and lowering of the first ring or inner ring to the minimum output. With such a two-ring gas burner, the sensing means should then of course be arranged close enough to the inner gas burner to always be impinged by its gas flames according to the situation described at the beginning.

It is possible that in the case where, after the detection of the taking away of the pot from the gas cooking point, no user input or operation of the gas hob for this gas cooking point, possibly even for any gas cooking point, takes place for a time that is longer than a first minimum time, this gas cooking point or the associated gas burner is switched off. This first minimum time may for example be between half a minute and 5 minutes or even up to 15 minutes. This is intended to achieve the effect that, after taking away of the pot after completion of the cooking operation, the gas burner or the gas cooking point is no longer required at all, and then is also switched off after a certain time. In this case, rapid readiness of the gas burner for increasing the output is then also no longer necessary.

In another configuration of the invention it is possible that, after the detection of the taking away of the pot, the gas cooking point or the gas burner is switched off entirely. This is then especially a mode with even greater safety and even more greatly reduced gas consumption. In this case it may be provided particularly advantageously that the switching off takes place without delay immediately after the detection of the taking away of the pot, so that for example the gas flames go out within a time of 2 seconds.

In one form of the invention it may be provided that the gas hob has touch switches for operating the gas cooking point or the gas cooking points. Advantageously, it has only touch switches. After detecting the taking away of the pot from the gas cooking point, the output at the gas cooking point can be reduced according to the first configuration mentioned at the beginning, that is to say if the gas supply is not stopped immediately. The detected taking away of the pot may be indicated to an operator optically and/or acoustically. Although the operator knows of course that he or she has taken the pot from the gas cooking point, this indication provides confirmation, in order that the operator knows that a control system of the gas hob or an automatic firing system that is usually provided has also actually detected the taking away of the pot. Advantageously, after renewed placing on of the pot, the operation of the gas cooking point then cannot automatically take place with a higher output than the minimum output, for example the previously set output, but instead the operator must perform an action. For this, a touch switch designed and provided for this may be provided with a further-operating function, and, when this is actuated after placing on the pot, the gas cooking point is operated again with the previously set output stage. This is of advantage especially for the case where the pot has been taken away from the gas cooking point only for a short time, in order to do something to the food or meal prepared in it but not because the cooking operation itself has already been completed. The fact that the operator must once again operate the further operator control element or the further touch switch in addition to placing the pot on means that a deliberate action is also envisaged.

In an extension of this form of the invention it may be provided that, in the case where the operator takes no action for a defined time, the gas cooking point or even the entire gas hob is switched off. This achieves the effect that, even in the case where the operator places the pot once again onto the gas cooking point but does not actuate the special touch switch for resuming the previous operation, which is necessary here, an error is assumed and it is then indeed switched off. This may once again be signaled optically and/or acoustically. Furthermore, it is possible that not only the operation of the touch switch with the further-operating function prevents the switching off of the gas cooking point, but its further operation is also possible by the operator using touch switches or operator control elements for setting the output to indeed perform an output setting. As a result, it is quite clearly also signaled that specific further operation of the gas cooking point is desired.

According to another form of the invention, the gas hob has for operating the gas cooking point mechanically movable operator control knobs, which may in particular be rotary knobs. This means knobs of which the positional rotary position is always associated with precisely one output setting or the like and which have a fixed zero setting, that is to say no rotary encoders or incremental encoders, which only sense relative rotational movement. Here, too, after the detection of the taking away of the pot from the gas cooking point, the output at the gas cooking point is reduced. Advantageously, once again a reduction to the minimum output takes place. For the case where the gas cooking point is put into operation again by renewed placing on of the pot, the output is increased again to the output previously set by the operator control knob. For this purpose, an operator control element designed for this, advantageously likewise a mechanically movable operator control element such as for example a pushbutton, may be actuated in order to restore the previously set output stage, which corresponds to a position of the operator control knob. Alternatively, the output may be increased again automatically, that is to say without intervention by the operator.

If in the case of the previously described form with a mechanically movable operator control knob the gas cooking point is switched off, and it is then intended that the gas hob or this gas cooking point can be put into operation again, firstly the operator control knob must be brought again into a zero position. The reason for this is because the operation of the gas cooking point or the gas burner can only begin when the output is increased from zero. The zero position of the operator control knob is used here for initialization. Especially in the case of such mechanically movable operator control knobs, a direct connection to an adjusting element for a gas valve for the gas burner is provided, and this cannot so easily be returned to zero. In the case of another advantageous form, an operator control knob may be connected purely electrically to the automatic firing system. The rotation into the zero position may then be used to re-initialize the gas cooking point.

It may generally be provided that a reduction in the output is indicated to an operator optically and/or acoustically. Similarly, switching off of the gas burner or the entire gas hob may be indicated, possibly however differently than the reduction in the output. An increase or resumption of a previously set output may also be correspondingly indicated, advantageously once again differently.

These and other features emerge not only from the claims but also from the description and the drawings, where the individual features can be realized in each case by themselves or as a plurality in the form of subcombinations in an embodiment of the invention and in other fields and can constitute advantageous and inherently protectable embodiments for which protection is claimed here. The subdivision of the application into individual sections and subheadings does not restrict the general validity of the statements made thereunder.

BRIEF DESCRIPTION OF THE SEVERAL VIEWS OF THE DRAWING(S)

An exemplary embodiment of the invention is schematically represented in FIG. 1 and is explained in more detail below.

FIG. 1 shows a schematic representation of a gas hob according to the invention with a previously described gas cooking point.

DETAILED DESCRIPTION

In FIG. 1, a gas hob 11 according to the invention is represented in section, with a hob area 12 and a gas cooking point 14, which is substantially formed by a gas burner 16 and a pot support 19. The gas burner 16 has a usual burner body 17 and a burner cover 18. The pot support 19 has a number of arms, on which a pot 20 has been placed.

A gas supply to the gas burner 16 takes place by way of a gas feed line 21 and by means of a gas valve 23, which is connected to a main feed line 22, with which a number of gas valves of the gas hob 11 can be supplied. An automatic firing system 25, which is equipped with an ignition electrode 26 for igniting the flame, serves for the activation of the gas valve 23.

The automatic firing system 25 is connected to a hob control system 28, which represents the main control for the gas hob 11 and corresponds to an aforementioned control assembly.

Operator control commands from an operator to the hob control system 28 or to the gas hob 11, such as for example for setting the output, may be input by means of a rotary knob 30 and an additional operator control element 32, the two of which together with the signal transmitter 33 are connected to the hob control system 28 by way of a bus system 29. An additional operator control element could also be integrated in the rotary knob 30. Instead of the mechanically movable rotary knob 30, touch switches could also be provided, for example for setting the output. Up to this point, the set-up and function of the gas hob 11 corresponds to the prior art.

According to the invention, a thermocouple 34 is arranged as the sensing means mentioned at the beginning at the gas cooking point 14 or near the gas burner 16, to be precise to the left of the gas burner 16. The distance from the thermocouple 34 to the gas burner 16 may for instance be equal to that of the ignition electrode 26. It should be ensured that the thermocouple 34 is always directly impinged by flames of a gas burner 16 in the way represented, or that they reach up close to the thermocouple 34 in such a way that at every output stage of the gas burner 16 possible for a sustained period it is either impinged directly by the flames or at least impinged directly by the hot gas stream of the flames. This therefore applies both with the minimum output of the gas burner 16 and with the maximum output as well as output stages lying in between. The thermocouple 34 is likewise connected to the automatic firing system 25, which therefore controls both the ignition of the gas burner by way of the ignition electrode 26 and the flame detection by way of the thermocouple 34.

In the automatic firing system 25, the thermoelectric voltage generated by the thermocouple 34 is sensed. The level of this thermoelectric voltage depends on the temperature at the thermocouple 34, and consequently on the intensity of the gas flame and on its alignment with respect to the thermocouple 34. Tests conducted in the course of devising the invention have shown that the temperature at the thermocouple 34 depends on the intensity of the gas flame, and consequently on the burner output. However, the tests have shown especially that the temperature at the thermocouple 34 also depends on whether the pot 20 has been placed onto the gas cooking point 14 or whether it has been taken away. In the first case of the placed-on pot, the gas flames usually extend upwards with a somewhat shallower angle, in the second case with a greater or steeper angle. However, as explained at the beginning, the thermocouple should be arranged in such a way that it is in both cases impinged by the gas flames, or at least their hot air stream, over the entire output range of the gas burner 16. As explained above, depending on the presence or removal of the pot 20, the temperature at the thermocouple 34 changes, and consequently so too does its generated thermoelectric voltage. This is so because, when the pot 20 is taken away, the gas flame burns at this steeper angle, the impingement of the thermocouple 34 with a gas flame changes and under some circumstances becomes less, and consequently so too does its temperature and its thermoelectric voltage. The control system 28 and the automatic firing system 25 can however differentiate this case very clearly from the case of a reduction in the output, in the case of which the impingement of the thermocouple also becomes different, since they would themselves set a reduction in the output at the gas valve 23, and consequently have this information available to them.

Depending on the geometrical or structural configuration of the set-up of the gas cooking point 14 with the pot support 19, the gas burner 16 and the thermocouple 34, a certain detection threshold may be provided for the thermoelectric voltage of the thermocouple 34, from which taking away of the pot 20 is detected by falling or changing of the thermoelectric voltage. It may thus be implemented for example that, when there is a falling or changing of the thermoelectric voltage by at least 30%, alternatively by at least 50%, taking away of the pot 20 from the gas cooking point 14 is detected and is assessed as such. The time dependence, or how quickly the thermoelectric voltage falls or rises when the pot is taken away, is particularly important.

A further advantage of the arrangement of the thermocouple 34 relatively close to the gas burner 16, and consequently relatively centrally in relation to the position of a placed-on pot 20, is that a possibly unintentional relatively great displacement of the pot 20, in the case of which a sensing means arranged a long way towards the outer area could no longer correctly sense a buildup of heat under the pot since the pot is located more over it, does not have adverse effects. The central region closely surrounding the gas burner will actually always be covered by the pot.

As explained above, after detecting the taking away of the pot from the gas cooking point 14, the control system 28 with the automatic firing system 25 may reduce the output of the gas burner 16, either to a minimum output or else switch it off entirely. In the case represented here of a gas hob 11 with the mechanical rotary knob 30, it is not possible after taking away the pot 20 to turn this rotary knob 30 automatically, either to a lower output stage or to zero. This is so because this rotary knob 30 has a fixed assignment between the rotary position and the output setting. In this case, after replacing the pot 20 onto the gas cooking point 14, an operator can restore the previously set output stage by actuating the additional operator control element 32, in particular in the case where the gas burner 16 has been switched off completely. If the output at the gas burner 16 has only been reduced to the minimum output, the placing on of the pot can be detected by means of the thermocouple 34 and a rising thermoelectric voltage or a change in the thermoelectric voltage, as described above, so that a return to the previously set output could possibly also take place automatically. Alternatively, an operator may also select at the rotary knob 30 an output stage that is different from the one previously set and, by actuating the additional operator control element 32, initiate renewed ignition of the gas burner 16 by way of the automatic firing system 25.

However, as long as the additional operator control element 32 has not been pressed to restore the previously set output or to set a new output after complete switching off of the gas burner 16, the cooking point remains either at the reduced output or switched off. The taking away of the pot may be indicated by flashing of the signal transmitter 33. Here, too, the gas cooking point 14 may be switched off after a defined time, for example half a minute to ten minutes, in which it has been operated with reduced output if no further operator input has taken place. In order then to put the gas cooking point 14 back into operation again, firstly the rotary knob 30 must be brought into its zero position, then the normal starting procedure can be followed.

If the rotary knob 30 for setting the output is however designed as an incremental encoder, that is to say only the rotary path covered and not the rotary position is decisive for determining a set output stage, or if only touch switches are used for setting the output, as explained above, after the detection of the taking away of the pot 20 from the gas cooking point 14, the output stage may either also be set to a reduced output, advantageously the minimum output, or else the gas cooking point 14 may be switched off completely. The taking away of the pot may be indicated to an operator by way of the signal transmitter 33. If the pot 20 is then placed once again onto the gas cooking point and it is intended to be operated with the previously set output, this can either take place automatically after detection of the placing on of the pot in the case of an output reduction to the minimum output or else only take place after actuation of the additional operator control element 32. In the case of complete switching off of the gas cooking point 14, the additional operator control element 32 must be actuated, since of course detection of placement of the pot 20 onto the gas cooking point 14 is then not possible, at least not by way of the thermocouple 34.

Furthermore, it is also possible, as has been described above, that the gas cooking point 14 is switched off completely after a certain time if no input by an operator takes place after the taking away of the pot 20. This may for example be a time of between 2 minutes and 20 minutes.

It is easily conceivable that an ionization electrode mentioned at the beginning may be used as the sensing means instead of the thermocouple 34. This should then be arranged at the same location as the thermocouple 34. In a way similar to that described above for the thermoelectric voltage, the ionization current flowing through it depends on the intensity of the gas flame or on the intensity of the impingement of the ionization electrode with the gas flame. It is consequently also possible with an ionization electrode to differentiate well by way of the ionization electrode whether or not a pot 20 has been placed onto the gas cooking point 14.

In an advantageous configuration of the invention, however, after the pot 20 has been placed on again, even if this can be detected and has been detected, the output is not automatically increased again or the previously set output is not automatically set. Rather, an operator must indeed carry out a deliberate action, advantageously actuate the previously described additional operator control element 32.

On the basis of the representation of FIG. 1, it is also easily conceivable how the invention functions in the case of a two-ring gas burner. This could be additionally arranged at some distance around the outside of the gas burner 16 and be connected to it by way of an ignition bridge. Consequently, the gas burner does not need an ignition electrode or flame monitor for the outer ring. Since the outer ring is supplied with gas by a further gas valve of its own, but this possibly takes place by way of the same automatic firing system 25, this is performed in such a way that it is only supplied with gas whenever both the inner ring or the gas burner 16 is also supplied with gas and the gas flame is burning. This is so because then it is ensured by way of this ignition bridge that the gas flowing out at the outer ring also burns. Under some circumstances, it may be sufficient within the scope of the invention as a reduction according to the invention of the output at the gas cooking point if, after detection of the taking away of the pot, the outer ring is switched off entirely by closing of its gas valve, but the inner ring or the gas burner 16 continues to be operated with the output previously set for it itself. In this way too, a significant and advantageous saving of energy is already possible.

To increase the certainty of the detection of the taking away of the pot 20 from the gas cooking point, it may generally be provided that this is only detected as taking away of the pot whenever the change in the signal of the thermoelectric voltage of the thermocouple 34 or of an ionization current of an ionization electrode is sustained for a certain time. In this way, short-term fluctuations, such as for example taking away of the pot for a few seconds with subsequent replacement or a change in the gas flame in the event of strong gusts of wind or the like, can be ruled out. It is thus generally possible that the change in the signal must be for at least 10 seconds or 20 seconds, or still persist after 10 seconds or after 20 seconds, in order to be detected as certain taking away of the pot. This time may possibly also be changed by an operator in a basic setting for adaptation to individual circumstances or habits.

That which is claimed:

1. A method of pot detection at a gas cooking point with a gas burner of a gas hob, wherein a sensing means with a function of flame sensing or temperature sensing is fitted at said gas cooking point in the form of an ionization electrode or a thermocouple, wherein said sensing means is fitted at said gas cooking point in such a way that, during operation of said gas burner, with every output of said gas burner possible for a sustained period said sensing means is impinged by said flames, and consequently is always impinged by a flame, the method comprising:

detecting whether a pot has been placed onto said gas cooking point while said gas burner is in operation or whether said pot has been taken away, in an instance in which an electrical signal is tapped at said sensing means and evaluated by a comparison of said signal at the time with said signal in said case where a pot has been placed on, wherein a different flame or a different temperature prevails at said sensing means in an instance in which a pot has been placed on than an instance in which said pot has been taken away, said output at said gas cooking point being reduced as a reaction to detection of said taking away of said pot, wherein, after said detection of said taking away of said pot, said output at said gas cooking point is reduced to a minimum output of said gas cooking point or to a minimum output of said gas burner, and wherein said reduction in said output takes place immediately after said detection of said taking away of said pot.

2. The method according to claim 1, wherein said sensing means comprises a single sensing means.

3. The method according to claim 1, wherein, in the case where said gas burner is a two-ring gas burner, a second ring or an outer ring is switched off entirely and a first ring or an inner ring is operated with reduced output.

4. The method according to claim 3, wherein said first ring or said inner ring is operated with a minimum output applicable to said first ring or said inner ring.

5. A method of pot detection at a gas cooking point with a gas burner of a gas hob, wherein a sensing means with a function of flame sensing or temperature sensing is fitted at said gas cooking point in the form of an ionization electrode or a thermocouple, wherein said sensing means is fitted at said gas cooking point in such a way that, during operation of said gas burner, with every output of said gas burner possible for a sustained period said sensing means is impinged by said flames, and consequently is always impinged by a flame, the method comprising:

detecting whether a pot has been placed onto said gas cooking point while said gas burner is in operation or whether said pot has been taken away, in an instance in which an electrical signal is tapped at said sensing means and evaluated by a comparison of said signal at the time with said signal in said case where a pot has been placed on, wherein a different flame or a different temperature prevails at said sensing means in an instance in which a pot has been placed on than an instance in which said pot has been taken away, said output at said gas cooking point being reduced as a reaction to detection of said taking away of said pot, wherein, after said detection of said taking away of said pot, said output at said gas cooking point is reduced to a minimum output of said gas cooking point or to a minimum output of said gas burner, and wherein, in the case where, after said detection of said taking away of said pot, no user input or operation of said gas hob for said gas cooking point takes place for a time that is longer than a first minimum time, said gas cooking point or said gas burner is switched off.

6. The method according to claim 1, wherein, after said detection of said taking away of said pot, said gas cooking point or said gas burner is switched off entirely.

7. The method according to claim 6, wherein said switching off takes place immediately after said detection of said taking away of said pot.

8. A method of pot detection at a gas cooking point with a gas burner of a gas hob, wherein a sensing means with a function of flame sensing or temperature sensing is fitted at said gas cooking point in the form of an ionization electrode or a thermocouple, wherein said sensing means is fitted at said gas cooking point in such a way that, during operation of said gas burner, with every output of said gas burner possible for a sustained period said sensing means is impinged by said flames, and consequently is always impinged by a flame, the method comprising:

detecting whether a pot has been placed onto said gas cooking point while said gas burner is in operation or whether said pot has been taken away, in an instance in which an electrical signal is tapped at said sensing means and evaluated by a comparison of said signal at the time with said signal in said case where a pot has been placed on, wherein a different flame or a different temperature prevails at said sensing means in an instance in which a pot has been placed on than an instance in which said pot has been taken away, said output at said gas cooking point being reduced as a reaction to detection of said taking away of said pot, wherein operation of said gas cooking point takes place by means of touch switches, wherein, after said detection of said taking away of said pot, said output at said gas cooking point is reduced and said taking away of said pot is indicated to an operator optically or acoustically, and wherein, after renewed placing on of said pot, said gas cooking point is operated again with said previously set output stage by initiating a further-operating function by way of a touch switch designed for this.

9. The method according to claim 8, wherein, in the case where said operator takes no action for a defined time, said gas cooking point or said entire gas hob is switched off.

10. The method according to claim 1, wherein operation of said gas cooking point takes place by means of mechanically movable operator control knobs, wherein, after said detection of said taking away of said pot from said gas cooking point, said output at said gas cooking point is reduced, and said output is increased again in the case where said gas cooking point is put into operation again after renewed placing on of said pot, a previously set output stage being restored by renewed actuation of a mechanically movable operator control element designed for this, in a way corresponding to a position of said operator control knob.

11. The method according to claim 10, wherein, after said complete switching off of said gas cooking point as a reduction in said output, said mechanically movable operator control knob must first be brought into a zero position before said gas hob or said gas cooking point can be put into operation again.

12. The method according to claim 10, wherein said output at said gas cooking point is reduced to said minimum output.

13. The method according to claim 10, wherein said mechanically movable operator control knobs are rotary knobs.

14. The method according to claim 1, wherein said reduction in said output is indicated to an operator optically or acoustically.

15. A gas hob comprising:

at least one gas cooking point with a gas burner; and a sensing means with a function of flame sensing or temperature sensing is fitted at said gas cooking point in the form of an ionization electrode or a thermocouple, wherein said sensing means is fitted at said gas cooking point in such a way that, during said operation of said gas burner, with every output of said gas burner possible for a sustained period it is impinged by said flames, and consequently is always impinged by a flame, said gas hob being designed for carrying out the method according to claim 1.

16. The gas hob according to claim 15, wherein said sensing means comprises a single sensing means.

* * * * *